US010233619B1

(12) United States Patent
Lin et al.

(10) Patent No.: US 10,233,619 B1
(45) Date of Patent: Mar. 19, 2019

(54) FAUCET HAVING SUPPORT BRACKET

(71) Applicant: Globe Union Industrial Corp., Taichung (TW)

(72) Inventors: Yiping Lin, Taichung (TW); Yueping Xiao, Shen Zen (CN); Yungcheng Yu, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 15/702,968

(22) Filed: Sep. 13, 2017

(51) Int. Cl.
*E03C 1/04* (2006.01)

(52) U.S. Cl.
CPC .... *E03C 1/0404* (2013.01); *E03C 2001/0414* (2013.01); *Y10T 137/9464* (2015.04)

(58) Field of Classification Search
USPC ..... 137/801
See application file for complete search history.

(56) References Cited

U.S. PATENT DOCUMENTS 1,714,232 A * 5/1929 Morris ..... B04B 15/12 137/209
2,492,049 A * 12/1949 Krone ..... B61K 11/02 137/615
4,709,715 A * 12/1987 Knight ..... A47L 17/00 134/177
5,185,893 A * 2/1993 Lin ..... E03C 1/023 137/597
5,492,148 A * 2/1996 Goughneour ..... E03C 1/06 137/616.5
6,820,291 B1 * 11/2004 Weaver ..... F16L 19/0218 239/588
D534,990 S * 1/2007 Zhou ..... D23/238
7,197,776 B2 * 4/2007 Tsai ..... E03C 1/06 248/230.1
D651,284 S * 12/2011 Flowers ..... D23/243
8,070,076 B2 * 12/2011 Erickson ..... E03C 1/0404 239/279
8,621,681 B2 * 1/2014 MacAn ..... E03C 1/066 4/615
9,850,642 B2 * 12/2017 Enlow ..... E03C 1/0404
2008/0083844 A1 * 4/2008 Leber ..... E03C 1/06 239/600
2013/0019974 A1 * 1/2013 Laera ..... E03C 1/0404 137/801
2015/0308088 A1 10/2015 Enlow et al.

* cited by examiner

*Primary Examiner* — Marina A Tietjen
*Assistant Examiner* — Daphne M Barry
(74) *Attorney, Agent, or Firm* — Alan D. Kamrath; Kamrath IP Lawfirm, P.A.

(57) ABSTRACT

A faucet having a support bracket contains: a body, a flexible outlet pipe, a spray head, and a support bracket. The body includes a vertical axis extending along a central portion thereof; and the flexible outlet pipe extends outwardly from a top of the body and includes an outflow segment. The spray head is connected with the outflow segment, the support bracket includes a first rotatable connector disposed on the body and includes a first tab extending outwardly from the first rotatable connector, wherein the first tab has a first rotation axis separated a distance from and perpendicular to the vertical axis. The support bracket includes a second rotatable connector having a head segments and a distal segment, wherein the head segment is rotatably connected with the first tab to form a first movable joint, and the distal segment is connected with or removed from the spray head.

23 Claims, 20 Drawing Sheets

FAUCET HAVING SUPPORT BRACKET

FIELD OF THE INVENTION

The present invention relates to a faucet, and more particularly to the faucet which has a support bracket configured to support a spray head of the faucet.

BACKGROUND OF THE INVENTION

A faucet with articulating arm is disclosed in US Publication No. 20150308088A1 to overcome defects of pull-down faucets, for example, the sprayer cannot be flexibly fixed to a desired position.

The faucet includes a body; a hub mounted on a top of the body; two articulating arms rotatably connected with two sides of the hub respectively; a forearm rotatably coupled with one end of the articulating arms; a nest rotatably joined with one end of the forearm so as to magnetically attract with a sprayer; a waterway formed by a flexible tube and communicating with a top of the hub; the sprayer connecting with one end of the waterway so as to spray water.

The hub has a first pivot axis rotatably connected with the articulating arms and perpendicular to a longitudinal axis on the body. When the articulating arms are rotated over 90 degrees, the forearm touches and interferes the waterway to limit rotatable height and width of the sprayer.

The articulating arms are rotatably connected with the two sides of the hub by using the first pivot coupling and are limited by a diameter of the hub, so the first pivot coupling and the articulating arms occupy large space and influence aesthetics appearance. Furthermore, the body has a handle fixed thereon, thus interfering operation of the handle.

The articulating arms and the forearm are close to the waterway and the handle, so they are interfered by the waterway and the handle.

The sprayer tilts horizontally as the nest revolves relative to the forearm, but is cannot slant forward and backward, thus reducing flexibility of water supply.

The present invention has arisen to mitigate and/or obviate the afore-described disadvantages.

SUMMARY OF THE INVENTION

The primary objective of the present invention is to provide a faucet which has a support bracket rotatably connected with or removed from the body in an operation space so as to avoid interfering a handle.

Another objective of the present invention is to provide a faucet which has a support bracket rotatably connected with or removed from the body so as to maintain an operating firmness of movable joints and flexible adjustment of the spray head as rotating the spray head.

To obtain the above objectives, a faucet having a support bracket provided by the present invention contains: a body, a flexible outlet pipe, a spray head, and a support bracket.

The body includes a vertical axis extending along a central portion of the body.

The flexible outlet pipe extends outwardly from a top of the body and includes an outflow segment.

The spray head is in connection with the outflow segment of the flexible outlet pipe.

The support bracket includes a first rotatable connector disposed on the top of the body, and the support bracket includes a first tab extending outwardly from the first rotatable connector, wherein the first tab has a first rotation axis separated a distance from and perpendicular to the vertical axis. The support bracket further includes a second rotatable connector having a head segments and a distal segment, wherein the head segment is rotatably connected with the first tab so as to form a first movable joint, and the distal segment is connected with or removed from the spray head.

The second rotatable connector has a first connection portion having the head segment and a first coupling segment; a second connection portion having a second coupling segment and the distal segment, wherein the second coupling segment is rotatably connected with the first coupling segment so as to form a second movable joint.

The first connection portion includes two extensions; the two extensions have the head segment rotatably connected with two sides of the first tab, and the two extensions have the first coupling segment; the second coupling segment of the second connection portion has a second tab, two sides of which are rotatably coupled with the first coupling segment of the two extensions.

The faucet having the support bracket further contains a second rotatable connector configured to rotatably connect the head segment of the two extensions with the two sides of the first tab; a second rotation set configured to rotatably connect the first coupling segment of the two extension with the two sides of the second tab.

The head segment of the two extensions has two first fitting sleeves formed thereon; the first tab has two first columns separately extending outward from the two sides thereof; the first rotation set has two friction loops accommodated in the two first fitting sleeves respectively and limitedly retained on the two sides of the first tab individually, wherein the two friction loops are forced to deform flexibly; two screw bolts are configured to lock the two friction loops with the two first columns separately; two adjustable buttons are respectively screwed into the two first fitting sleeves so as to force the two friction loops to deform flexibly and to contact with the two first fitting sleeves respectively.

The first coupling segment of the two extensions have two second fitting sleeves formed thereon; the second tab has two second columns individually extending outward from the two sides thereof; and the second rotation set has another two friction loops accommodated in the second fitting sleeves respectively and limitedly retained on the two sides of the second tab individually, wherein said another two friction loops are forced to deform flexibly; two another screw bolts are configured to lock said another two friction loops with the two second columns separately of the second tab; two another adjustable buttons are screwed into the two second fitting sleeves respectively so as to force said another two friction loops to deform flexibly and to contact with the second fitting sleeve separately.

Between the distal segment of the support bracket and the spray head is defined a magnetic attraction structure so that the spray head is freely removed from the distal segment of the support bracket.

The distal segment of the support bracket has a peripheral knob made of magnetic attracting material; the spray head includes an accommodation groove defined therein so as to accommodate an annular magnet and to magnetically attracting the peripheral knob in the accommodation groove.

The head segment of the two extensions has two first fitting sleeves formed thereon; the first rotation set includes a first toothed seat rotatably housed in the first tab, and the first toothed seat has two first mesh portions arranged on two ends of the first toothed seat respectively; a positioning ring; an adjusting ring; two second toothed seats rotatably accommodated in the two first fitting sleeves separately, and each of the two second toothed seats has a second mesh portion configured to mesh with each of the two first mesh portions; two springs, one of which is mounted between the positioning ring and one of the two second toothed seats, and the other spring is fixed between the adjusting ring and the other second toothed seat; a rotary shaft screwed with the adjusting ring from the positioning ring via the one spring, the one second toothed seat, and the first toothed seat, such that the positioning ring, the one second toothed seat, and the adjusting ring are rotatably connected with the first toothed seat, wherein the two springs push against the two second toothed seats separately so that two second mesh portions of the two second toothed seats mesh with the two first mesh portions individually; two caps are screwed with the positioning ring and the adjusting ring so as to rotatably connect the two first fitting sleeves with the first tab.

The first coupling segment of the two extensions has two second fitting sleeves formed thereon; the second rotation set includes a first toothed seat rotatably housed in the first tab, and the first toothed seat has two first mesh portions arranged on two ends of the first toothed seat respectively; a positioning ring; an adjusting ring; two second toothed seats are rotatably accommodated in the two first fitting sleeves separately, and each of the two second toothed seats has a second mesh portion configured to mesh with each of the two first mesh portions; two springs, one of which is mounted between the positioning ring and one of the two second toothed seats, and the other spring is fixed between the adjusting ring and the other second toothed seat; a rotary shaft is screwed with the adjusting ring from the positioning ring via the one spring, the one second toothed seat, and the first toothed seat, such that the positioning ring, the one second toothed seat, and the adjusting ring are rotatably connected with the first toothed seat, wherein the two springs push against the two second toothed seats separately so that two second mesh portions of the two second toothed seats mesh with the two first mesh portions individually; two caps are screwed with the positioning ring and the adjusting ring so as to rotatably connect the two first fitting sleeves with the first tab.

The first connection portion has a first holding stem, wherein the holding stem has the head segment rotatably connected with the first tab, and the holding stem has a contacting segment; a second holding stem moving along the first holding stem, wherein the second holding stem has a lock segment and the first coupling segment, the lock segment extends out of the head segment of the holding stem and locked in the first tab, hence the first connection portion limitedly rotates relative to and locks with the first tab, the first coupling segment is biased against the contacting segment of the holding stem and is pulled by an external force to remove the lock segment from the first tab; the second coupling segment of the second rotatable connector has a second tab rotatably coupled with the first coupling segment of the second holding stem.

The first connection portion has a first holding stem, wherein the holding stem has the head segment rotatably connected with the first tab, and the holding stem has a contacting segment; a second holding stem moving along the first holding stem, wherein the second holding stem has a lock segment and the first coupling segment, the lock segment extends out of the head segment of the holding stem and locked in the first tab, hence the first connection portion limitedly rotates relative to and locks with the first tab, the first coupling segment is biased against the contacting segment of the holding stem and is pulled by an external force to remove the lock segment from the first tab; the second coupling segment of the second rotatable connector has a second tab rotatably coupled with the first coupling segment of the second holding stem.

The distal segment of the support bracket has a hook, an opening, a hanging space defined by the hook, and a cavity communicating with the opening and the hanging space; the spray head includes a neck portion hang on the hook from the opening via the cavity and retained in the hanging space.

Preferably, the first connection portion of the support bracket is rotated toward two angles so as to enhance stability of the support bracket. In addition, when the support bracket is not operated, the spray head is adjustably revolved to a desired angle by way of the magnetic attraction structure.

DETAILED DESCRIPTION OF THE PREFERRED EMBODIMENTS

Figure 1:
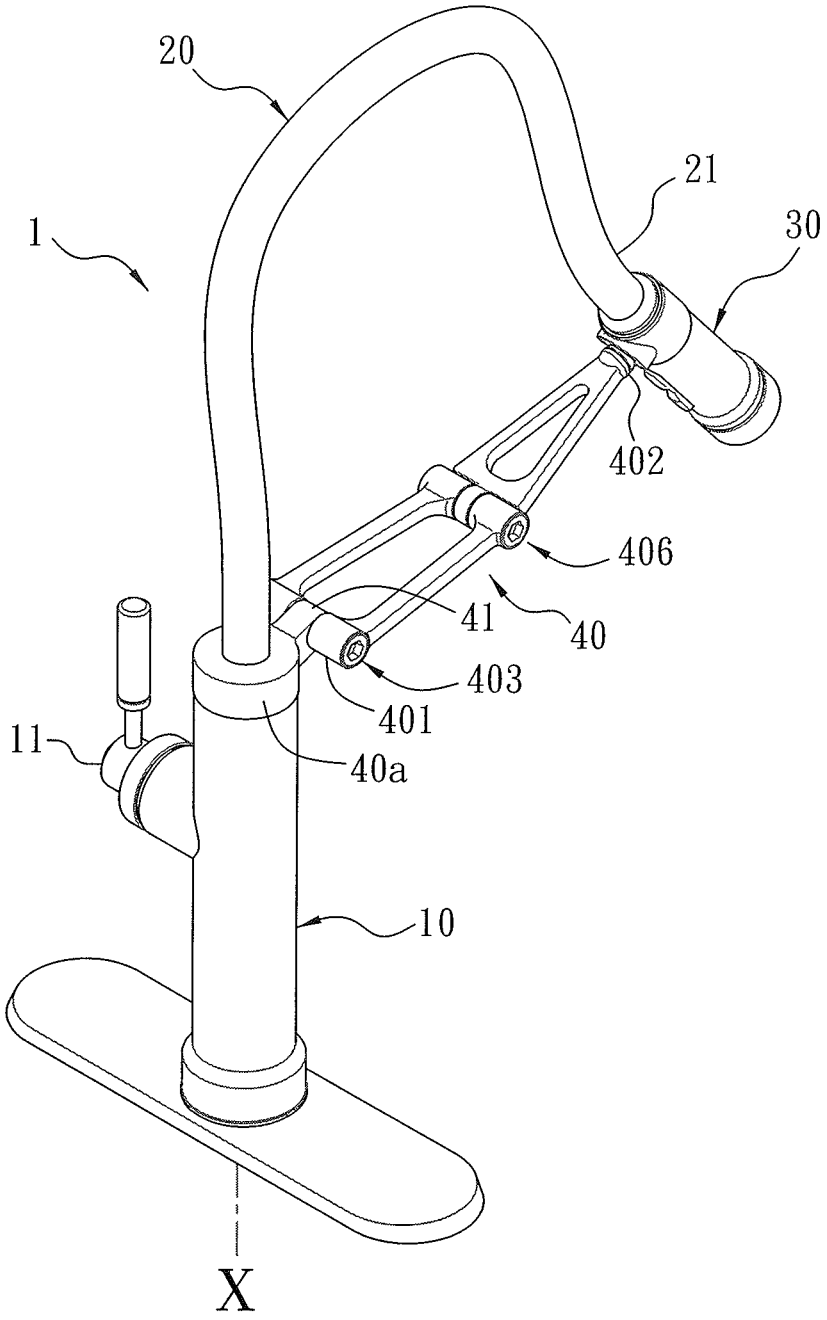
FIG. 1 is a perspective view showing the assembly of a faucet according to a first embodiment of the present invention.
Figure 2:
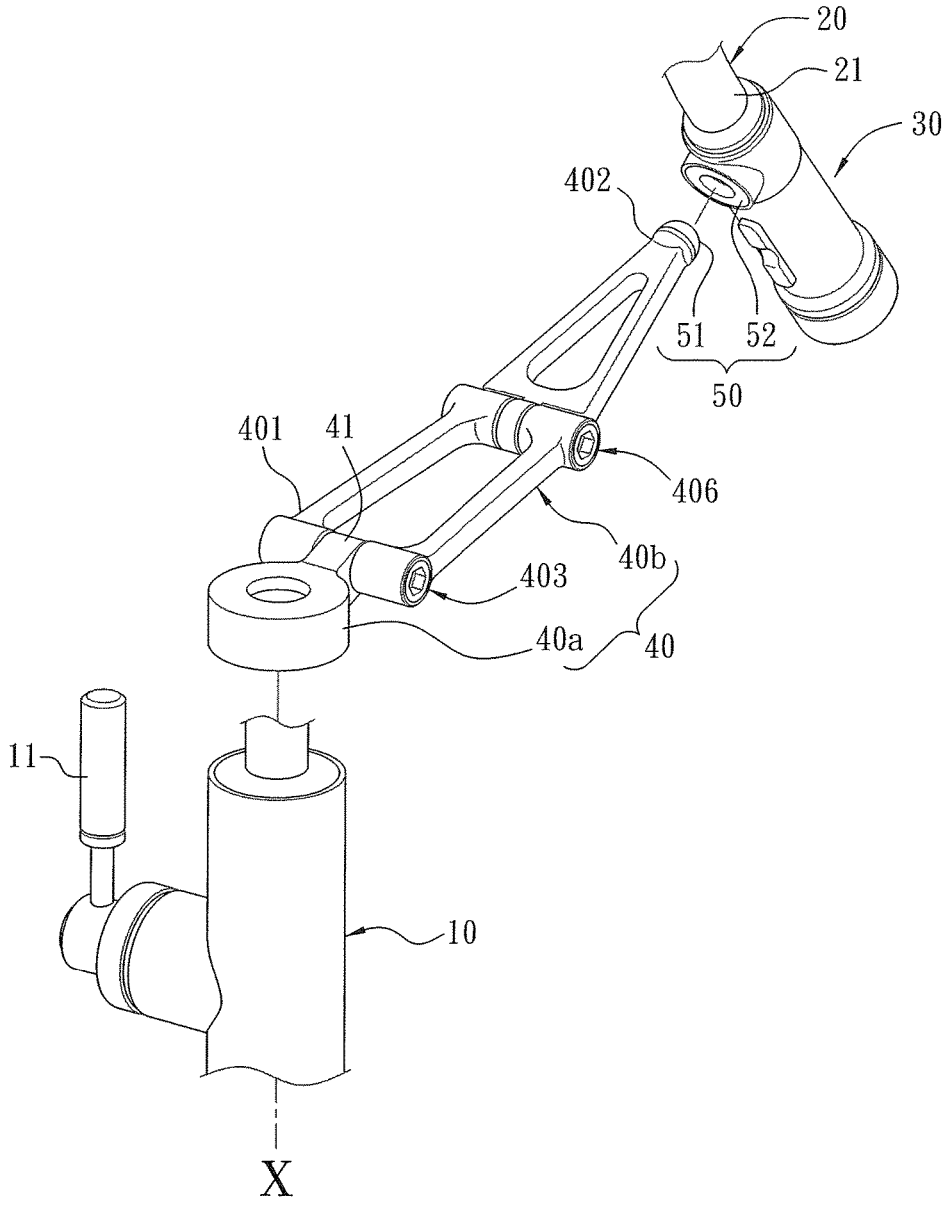
FIG. 2 is a perspective view showing the exploded components of a part of the faucet according to the first embodiment of the present invention.
Figure 3:
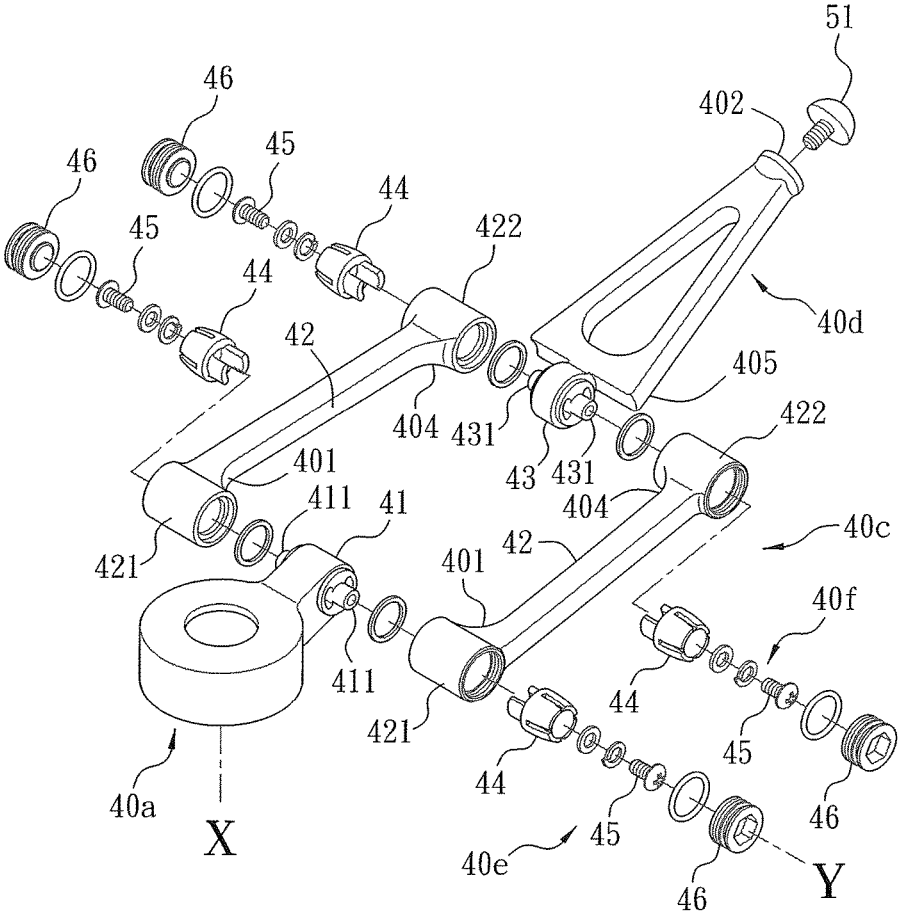
FIG. 3 is a perspective view showing the exploded components of a support bracket of the faucet according to the first embodiment of the present invention.

With reference to FIGS. 1-3, a faucet 1 having a support bracket according to a first embodiment of the present invention comprises: a body 10, a flexible outlet pipe 20, a spray head 30, and a support bracket 40.

The body 10 includes a vertical axis X extending along a central portion thereof and includes a handle 11 arranged on one side of the body 10.

The flexible outlet pipe 20 extending outwardly from a top of the body 10 and includes an outflow segment 21.

The spray head 30 is in connection with the outflow segment 21 of the flexible outlet pipe 20.

Figure 4:
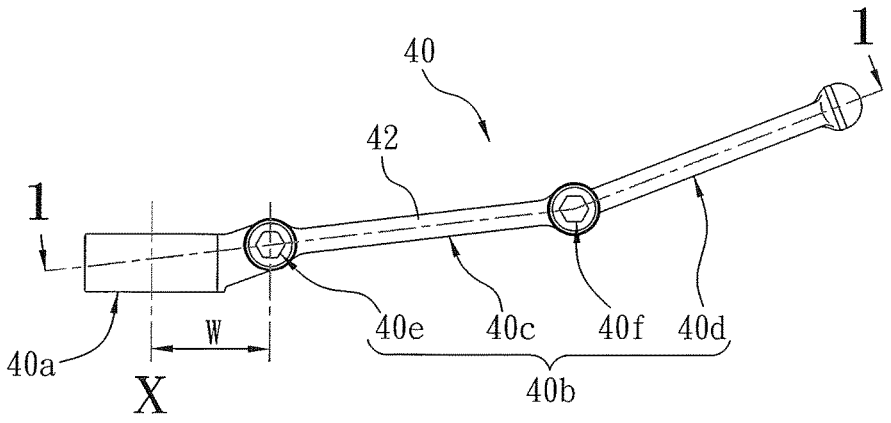
FIG. 4 is a side plan view showing the assembly of the support bracket of the faucet according to the first embodiment of the present invention.

The support bracket 40 includes a first rotatable connector 40*a* disposed on the top of the body 10, and the support bracket 40 includes a first tab 41 extending outwardly from the first rotatable connector 40*a*, wherein the first tab 41 has a first rotation axis Y separated a distance from and perpendicular to the vertical axis X, as shown in FIG. 4, wherein the distance is a width W. The support bracket 40 further includes a second rotatable connector 40*b* having a head segment 401 and a distal segment 402, wherein the head segment 401 is rotatably connected with the first tab 41 so as to form a first movable joint 403, and the distal segment 402 is connected with or removed from the spray head 30.

Preferably, the first rotation axis Y is perpendicular to and is not intersected with the vertical axis X, and the first rotation axis Y is separated the width W from the vertical axis X, hence the support bracket 40 is freely rotated between the body 10 and the spray head 30.

Referring to FIGS. 1-3, the second rotatable connector 40*b* has a first connection portion 40*c* having the head segment 401 and a first coupling segment 404; a second connection portion 40*d* having a second coupling segment 405 and the distal segment 402, wherein the second coupling segment 405 is rotatably connected with the first coupling segment 404 so as to form a second movable joint 406.

Thereby, the first movable joint 403 is rotatable with respect to the body 10, the flexible outlet pipe 20, and the handle 11. When the first connection portion 40*c* is rotated upwardly around/at 90 degrees, it does not touch the flexible outlet pipe 20, such that the second connection portion 40*d* and the spray head 30 are adjustably rotated toward a water sink close to the body 10 or toward a higher position. Furthermore, a width of the first movable joint 403 is decreased so that the handle 11 operates smoothly.

Referring to FIG. 3, the first connection portion 40*c* includes two extensions 42; the two extensions 42 have the head segment 401 rotatably connected with two sides of the first tab 41, and the two extensions 42 have the first coupling segment 404; the second coupling segment 405 of the second connection portion 40*d* has a second tab 43, two sides of which are rotatably coupled with the first coupling segment 404.

As illustrated in FIG. 3, the second rotatable connector 40*b* further has a first rotation set 40*e* configured to rotatably connect the head segment 401 of the two extensions 42 with the two sides of the first tab so as to form the first movable joint 403; a second rotation set 40*f* configured to rotatably connect the first coupling segment 404 of the two extension 42 with the two sides of the second tab 43 so as to form the second movable joint 406.

Figure 5:
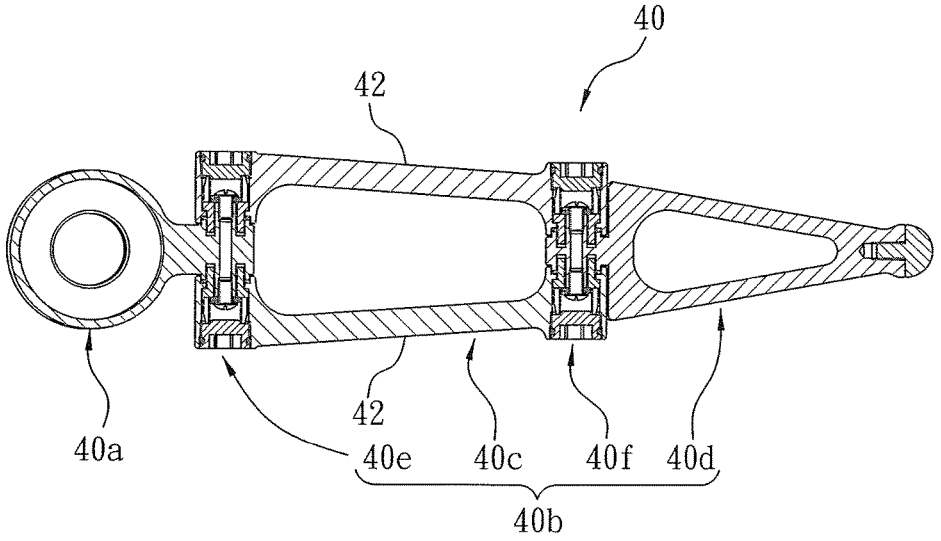
FIG. 5 is a cross sectional view taken along the line 1-1 of FIG. 4.
Figure 6:
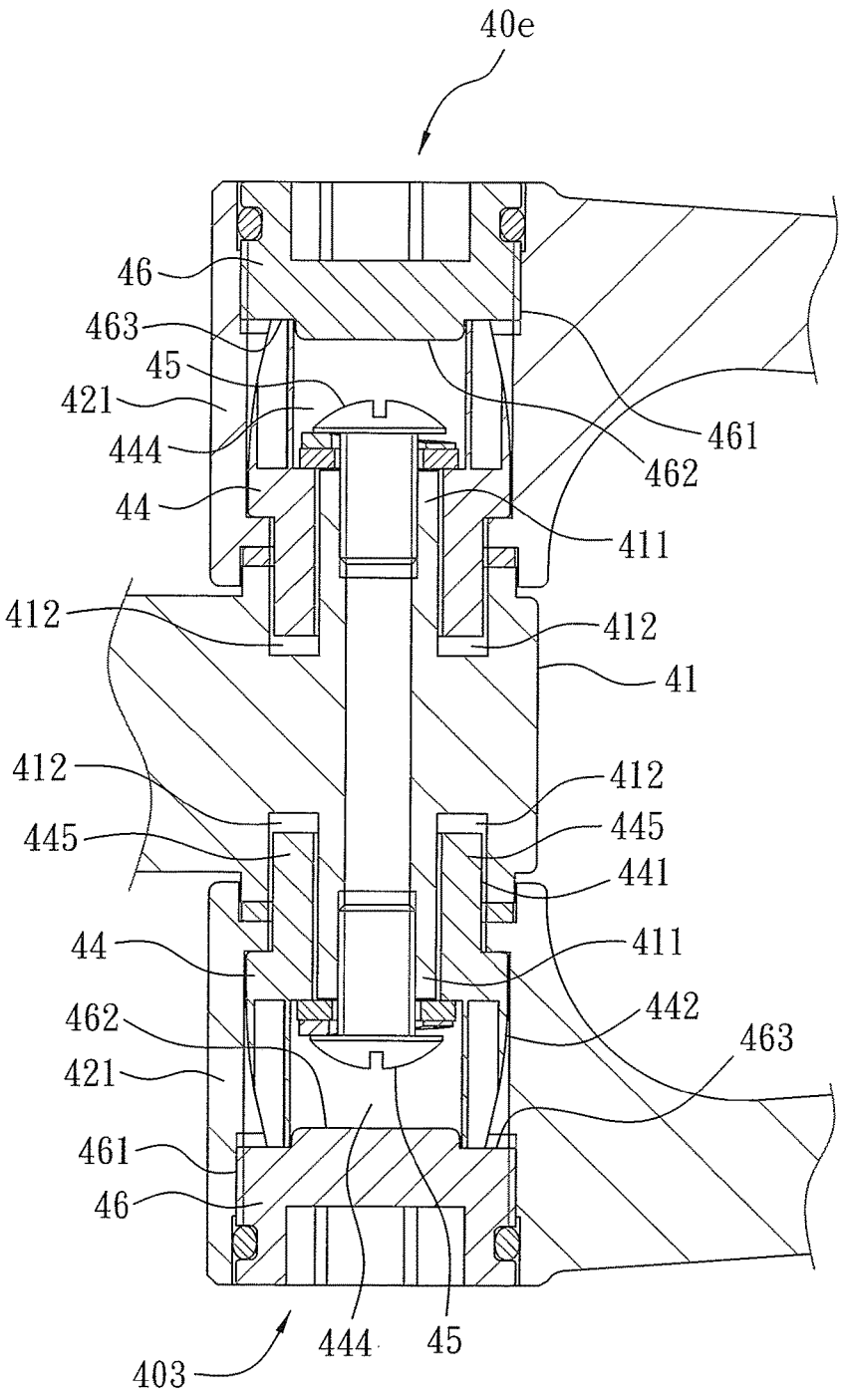
FIG. 6 is a cross sectional view showing the assembly of a first movable joint of FIG. 5 according to the first embodiment of the present invention.

With reference to FIGS. 3, 5 and 6, the head segment 401 of the two extensions 42 has two first fitting sleeves 421 formed thereon; the first tab 41 has two first columns 411 separately extending outward from the two sides thereof; the first rotation set 40*e* has two friction loops 44 accommodated in the two first fitting sleeves 421 respectively and limitedly retained on the two sides of the first tab 41 individually, wherein the two friction loops 44 are forced to deform flexibly; two screw bolts 45 are configured to lock the two friction loops 44 with the two first columns 411 separately; two adjustable buttons 46 are respectively screwed into the two first fitting sleeves 421 so as to force the two friction loops 44 to deform flexibly and to contact with the two first fitting sleeves 421 respectively, thus supporting the second rotatable connector 40*b* and the spray head 30, when water flows out of the faucet 1.

Figure 7:
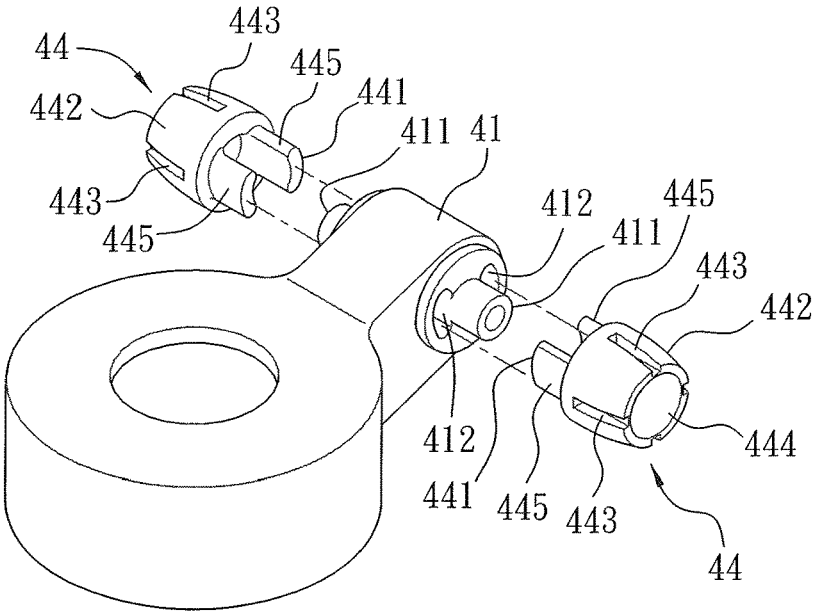
FIG. 7 is a perspective view showing the exploded components of a first rotatable connector and two friction loops of the faucet according to the first embodiment of the present invention.

Referring to FIGS. 6 and 7, the two friction loops 44 have two insertions 441 separately accommodated in the two sides of the first tab 41, and the two friction loops 44 respectively have two flexible deformation portions 442 matingly retaining with the two first fitting sleeves 421; wherein each of the two flexible deformation portions 442 is in a ring shape and has multiple slots 443 defined thereon, each flexible deformation portion 442 o has an orifice 444 formed thereon; each of the two adjustable buttons 46 has a contact segment 461 on which a protrusion 462 is formed, and each adjustable button 46 has an abutting face 463 defined around an outer wall of the protrusion 462 so as to abut against each friction loop 44, and the protrusion 462 is housed in the orifice 444 of each friction loop 44 so that each friction loop 44 flexibly deforms outward.

As illustrated in FIG. 7, each of the two first columns 411 of the first tab 41 has two first fixing notches 412 formed around an outer wall of each first column 411; and the insertion 441 of each friction loop 44 has two projections 445 retained in the two fixing notches 412 separately so as to limit rotation of each friction loop 44.

Figure 8:
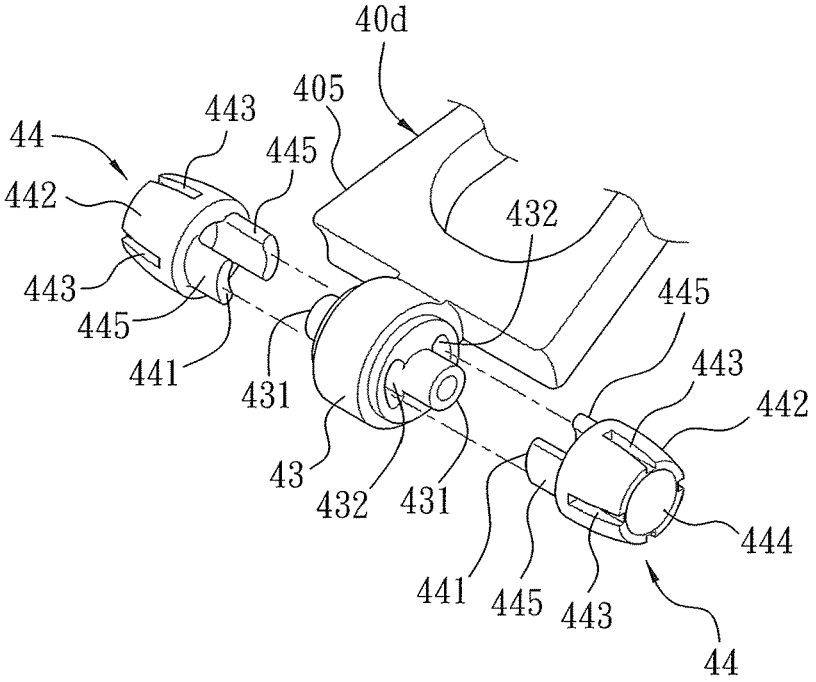
FIG. 8 is a perspective view showing the exploded components of a second connection portion and the two friction loops of the faucet according to the first embodiment of the present invention.
Figure 9:
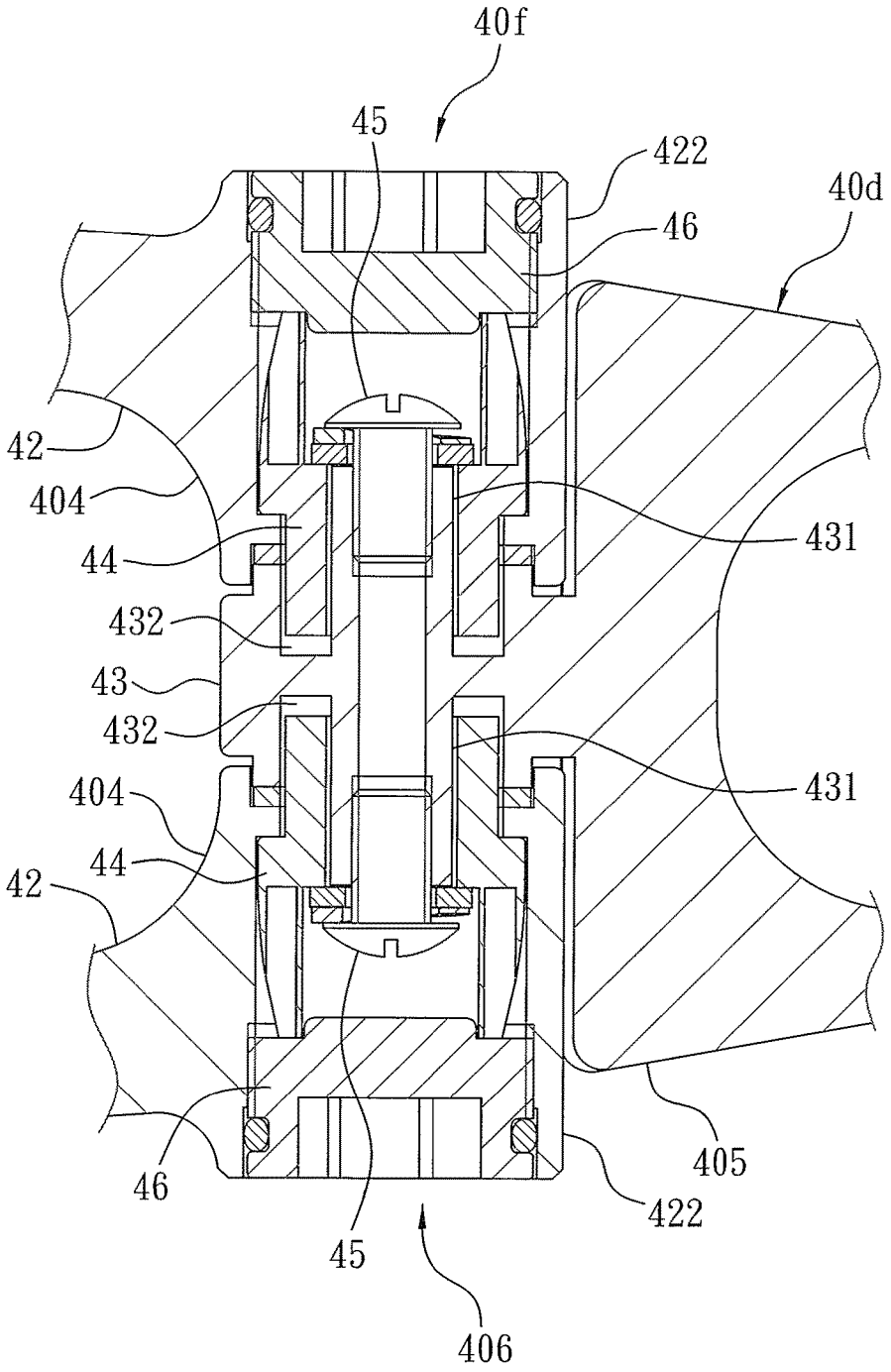
FIG. 9 is a cross sectional view showing the assembly of a second movable join of FIG. 5 according to the first embodiment of the present invention.

As illustrated in FIGS. 3, 8 and 9, the first coupling segment 404 of the two extensions 42 have two second fitting sleeves 422 formed thereon; the second tab 43 has two second columns 431 individually extending outward from the two sides thereof; and the second rotation set 40*f* has another two friction loops 44 separately accommodated in the two second fitting sleeves 422 and limitedly retained on the two sides of the second tab 43 individually, wherein said another two friction loops 44 are forced to deform flexibly; two another screw bolts 45 are configured to lock said another two friction loops 44 with the two second columns 431 separately of the second tab 43; two another adjustable buttons 46 are screwed into the two second fitting sleeves 422 respectively so as to force said another two friction loops 44 to deform flexibly and to separately contact with the two second fitting sleeves 422, thus supporting the second rotatable connector 40*d* and the spray head 30, when the water flows out of the faucet 1.

As illustrated in FIGS. 8-9, each of the two second columns 431 of the second tab 43 has two second fixing notches 432 formed around an outer wall of each second column 431; and an insertion 441 of each another friction loop 44 has two another projections 445 retained in the two second fixing notches 432 separately so as to limit rotation of each another friction loop 44.

Figure 10:
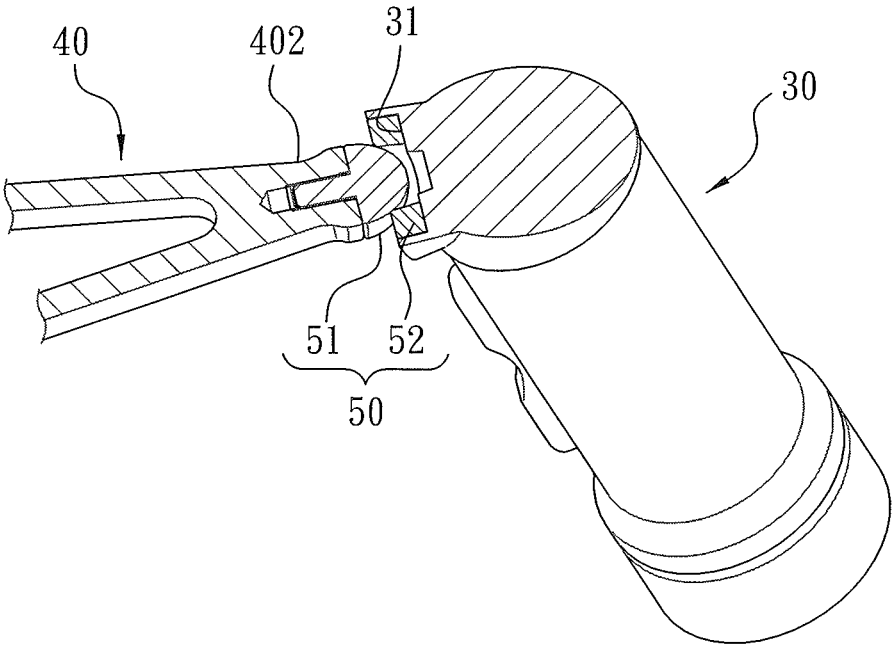
FIG. 10 is a cross-sectional perspective view showing the assembly of a second connection portion and a spray head of the faucet according to the first embodiment of the present invention.
Figure 11:
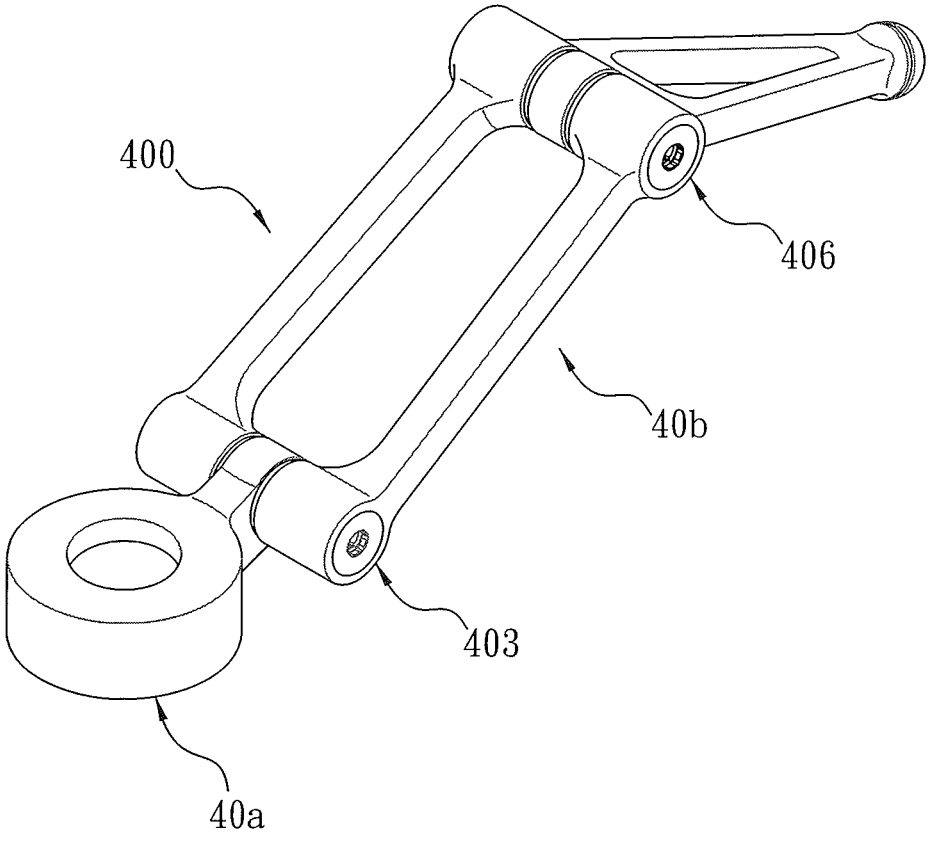
FIG. 11 is a perspective view showing the assembly of a support bracket of a faucet according to a second embodiment of the present invention.
Figure 12:
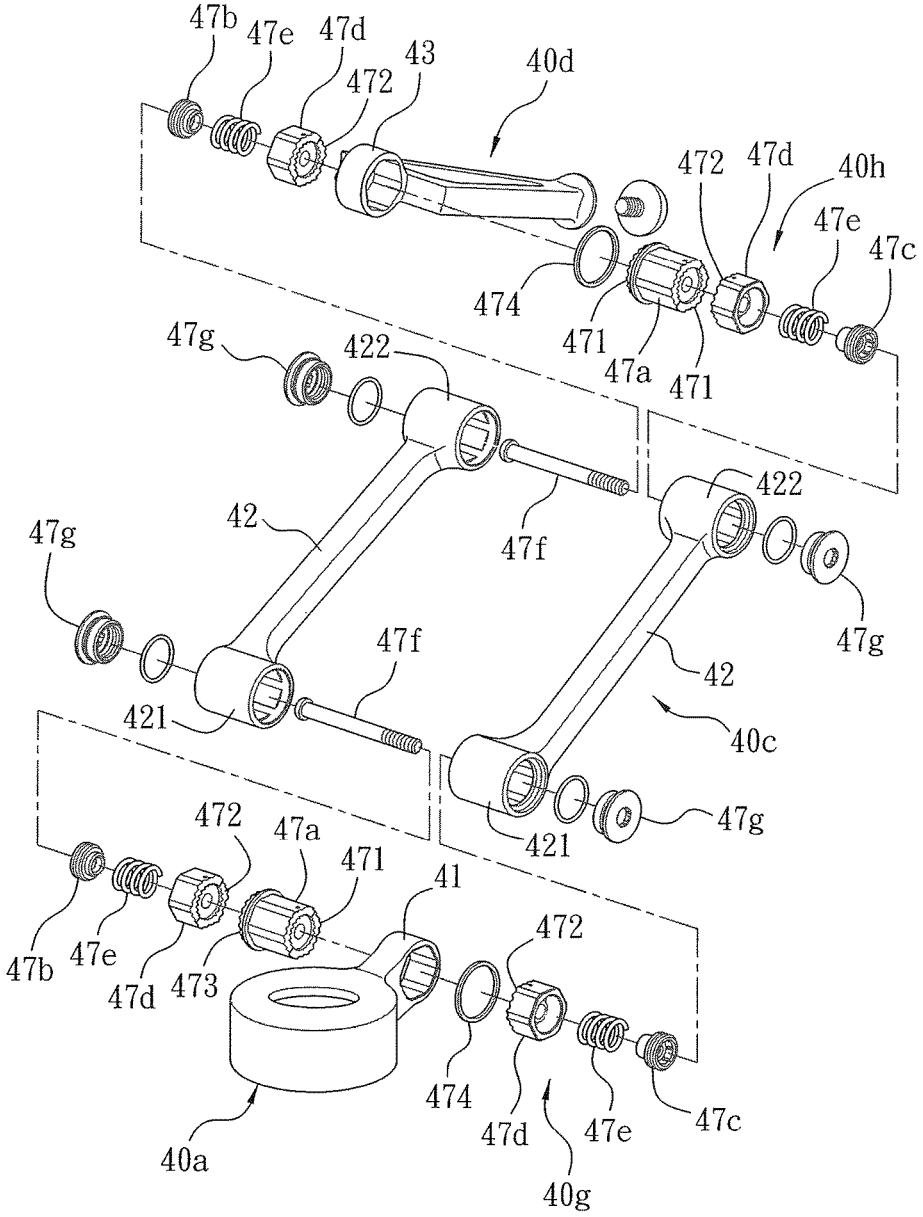
FIG. 12 is a perspective view showing the exploded components of the support bracket of the faucet according to the second embodiment of the present invention.
Figure 13:
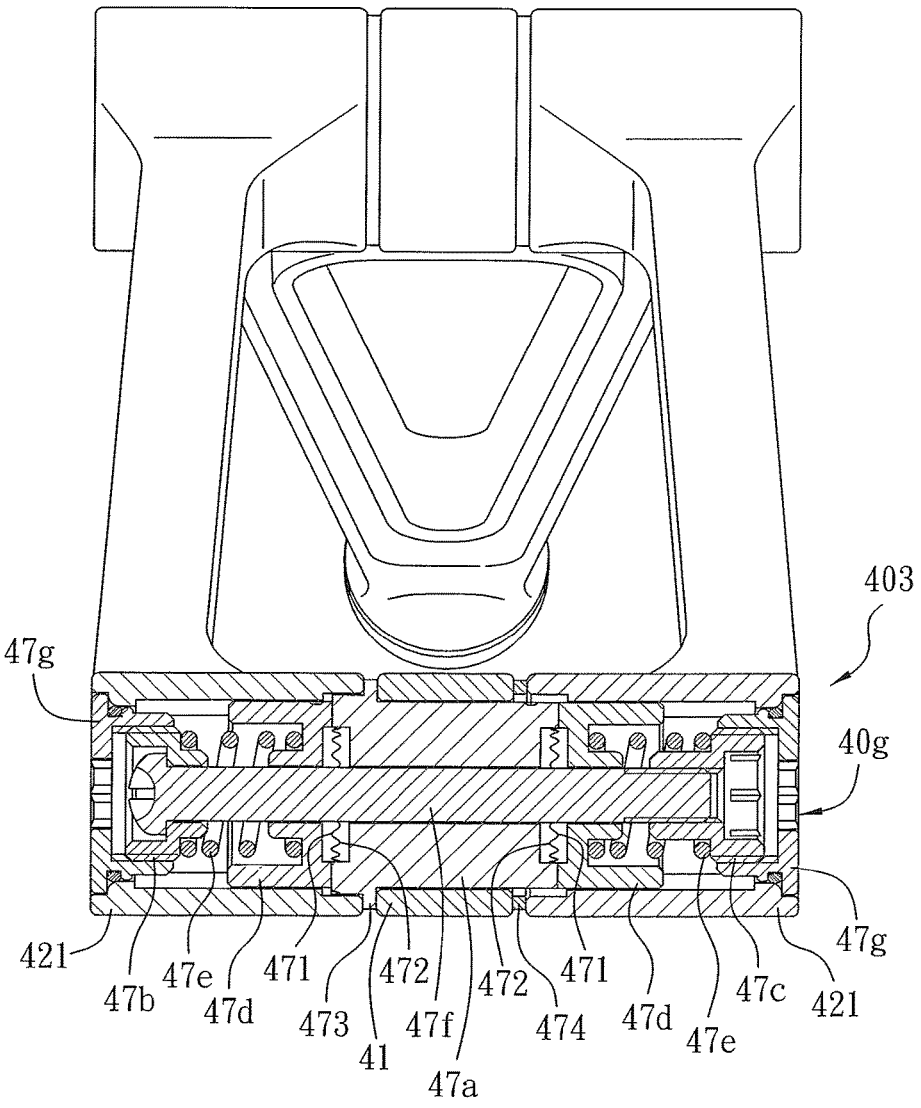
FIG. 13 is a perspective view showing the exploded components of a first movable joint of the support bracket of the faucet according to the second embodiment of the present invention.
Figure 14:
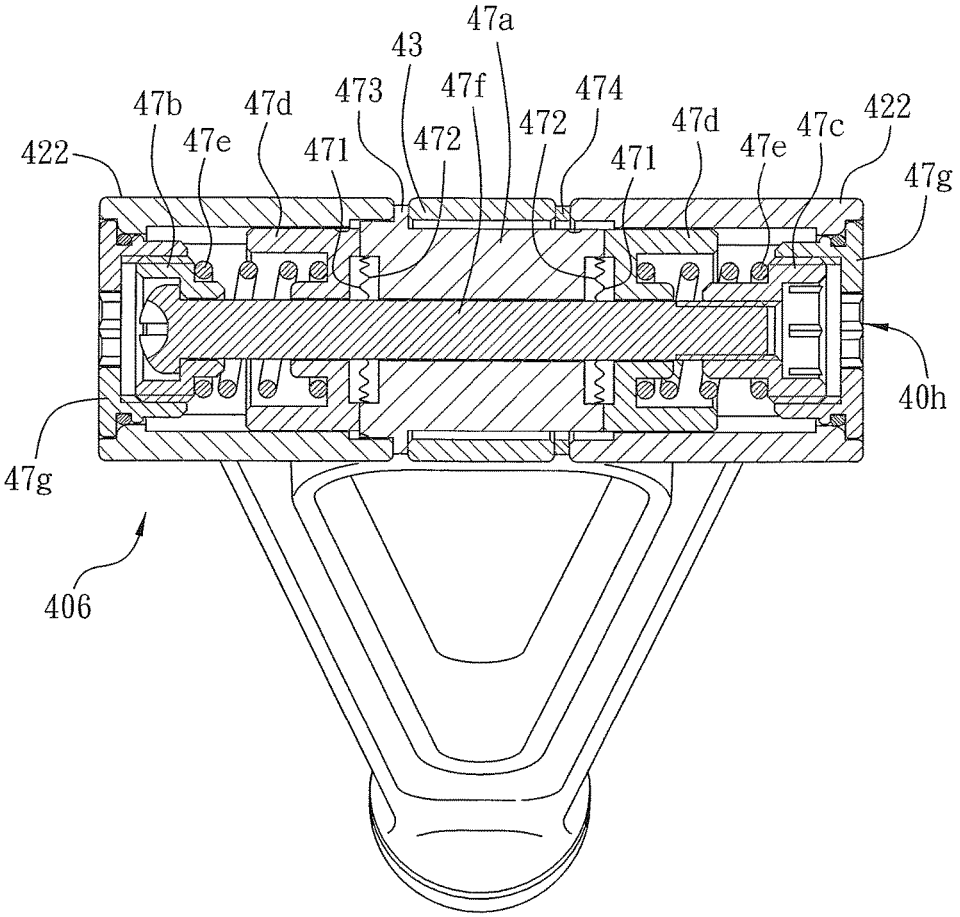
FIG. 14 is a perspective view showing the exploded components of a second movable joint of the support bracket of the faucet according to the second embodiment of the present invention.
Figure 15:
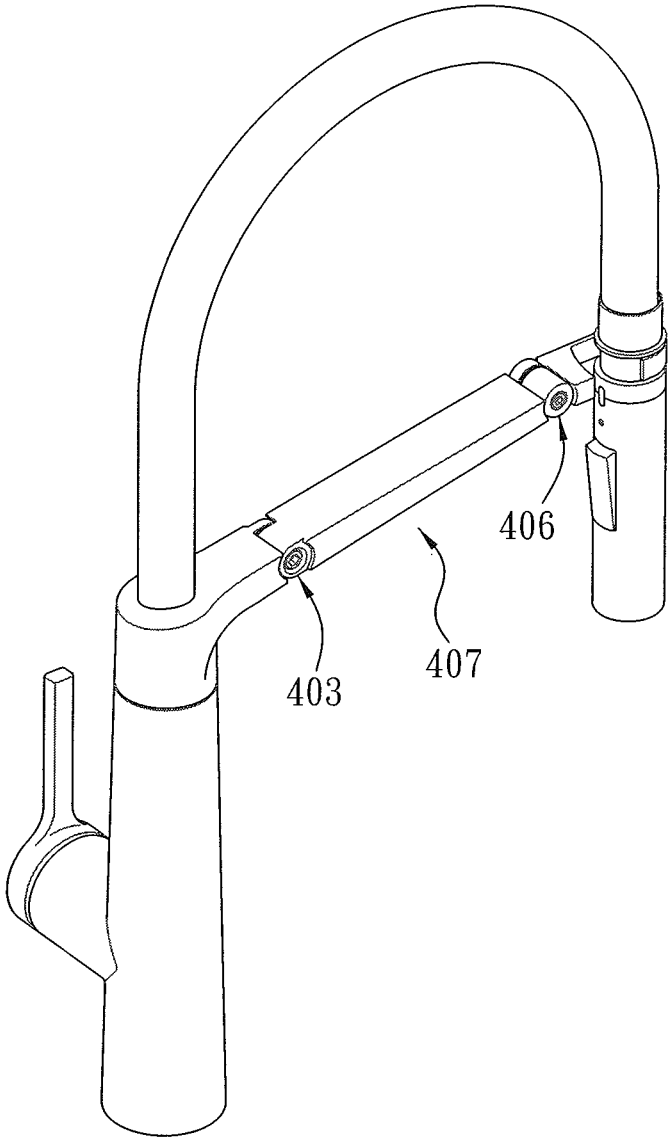
FIG. 15 is a perspective view showing the assembly of a faucet according to a third embodiment of the present invention.
Figure 16:
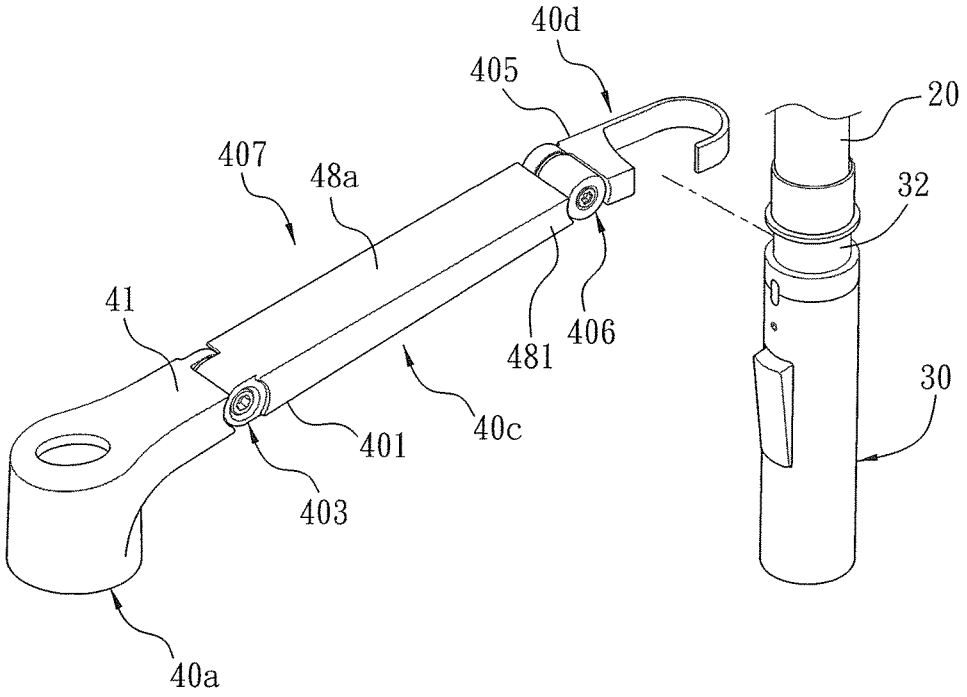
FIG. 16 is a perspective view showing the exploded components of a support bracket and a spray head of the faucet according to the third embodiment of the present invention.

As illustrated in FIGS. 2 and 10, between the distal segment 402 of the support bracket 40 and the spray head 30 is defined a magnetic attraction structure 50 so that the spray head 30 is freely removed from the distal segment 402 of the support bracket 40. Preferably, the distal segment 402 of the support bracket 40 has a peripheral knob 51 made of magnetic attracting material; the spray head 30 includes an accommodation groove 31 defined therein so as to accommodate an annular magnet 52 and to magnetically attracting the peripheral knob 51 in the accommodation groove 31, hence the peripheral knob 51, the support bracket 40, and the spray head are rotatably adjusted to enhance flexible rotation of the spray head 30. Preferably, when the spray head 30 is slightly rotated to a desired angle, the first movable joint 403 or the second movable joint 406 is not adjustably rotated ever time.

With reference to FIGS. 11-14, a difference of a faucet 1 having a support bracket of a second embodiment from that of the first embodiment comprises:

a first rotation set 40*g* including a first toothed seat 47*a* rotatably housed in the first tab 41, and the first toothed seat 47*a* having two first mesh portions 471 arranged on two ends of the first toothed seat 47*a* respectively; a positioning ring 47*b*; an adjusting ring 47*c*; two second toothed seats 47*d* rotatably accommodated in the two first fitting sleeves 421 separately, and each of the two second toothed seats 47*d* has a second mesh portion 472 configured to mesh with each of the two first mesh portions 471; two springs 47*e*, one of which is mounted between the positioning ring 47*b* and one of the two second toothed seats 47*d*, and the other spring 47*e* is fixed between the adjusting ring 47*c* and the other second toothed seat 47*d*; a rotary shaft 47*f* screwed with the adjusting ring 47*c* from the positioning ring 47*b* via the one spring 47*e*, the one second toothed seat 47*d*, and the first toothed seat 47*a*, such that the positioning ring 47*b*, the one second toothed seat 47*d*, and the adjusting ring 47*c* are rotatably connected with the first toothed seat 47*a*, wherein the two springs 47*e* push against the two second toothed seats 47*d* separately so that two second mesh portions 472 of the two second toothed seats 47*d* mesh with the two first mesh portions 471 individually; two caps 47*g* screwed with the positioning ring 47*b* and the adjusting ring 47*c* so as to rotatably connect the two first fitting sleeves 421 with the first tab 41.

The first toothed seat 47*a* has a limiting rib 473 extending outwardly from an outer end thereof so as to abut the first toothed seat 47*a* against one side of the first tab 41 opposite to the one positioning ring 47*b*; the first toothed seat 47*a* has a plastic washer 474 fitted thereon and defined between the other side of the first tab 41 and one of the two first fitting sleeves 421, wherein the other side of the first tab 41 is opposite to the adjusting ring 47*c*, and the one first fitting sleeve 421 accommodates the adjusting ring 47*c*, hence friction among the two first fitting sleeves 421 and the first tab 41 reduces.

Each of the two first mesh portions 471 and the two second mesh portions 472 has multiple teeth arranged thereon.

Each of the first tab 41 and the two first fitting sleeves 421 has a polygonal inner wall defined therein; and each of the first toothed seat 47*a* and the two second toothed seats 47*d* has a polygonal outer wall formed thereon.

The faucet 1 further comprises: a second rotation set 40*h* including a first toothed seat 47*a* rotatably housed in the second tab 43, and the first toothed seat 47*a* having two first mesh portions 471 arranged on two ends of the first toothed seat 47*a* respectively; a positioning ring 47*b*; an adjusting ring 47*c*; two second toothed seats 47*d* rotatably and respectively accommodated in the two second fitting sleeves 422, and each of the two second toothed seats 47*d* has a second mesh portion 472 configured to mesh with each of the two first mesh portions 471; two springs 47*e*, one of which is mounted between the positioning ring 47*b* and one of the two second toothed seats 47*d*, and the other spring 47*e* is fixed between the adjusting ring 47*c* and the other second toothed seat 47*d*; a rotary shaft 47*f* screwed with the adjusting ring 47*c* from the positioning ring 47*b* via the one spring 47*e*, the one second toothed seat 47*d*, and the first toothed seat 47*a*, such that the positioning ring 47*b*, the one second toothed seat 47*d*, and the adjusting ring 47*c* are rotatably connected with the first toothed seat 47*a*, wherein the two springs 47*e* push against the two second toothed seats 47*d* separately so that two second mesh portions 472 of the two second toothed seats 47*d* mesh with the two first mesh portions 471 individually; two caps 47*g* screwed with the positioning ring 47*b* and the adjusting ring 47*c* so as to rotatably and separately connect the two second fitting sleeves 422 with the second tab 43.

The first toothed seat 47*a* of the second rotation set 40*h* has a limiting rib 473 extending outwardly from an outer end thereof so as to abut the first toothed seat 47*a* against one side of the second tab 43 opposite to the one positioning ring 47*b*, and the first toothed seat 47*a* of the second rotation set 40*h* abuts against one of the two second fitting sleeves 422, wherein the first toothed seat 47*a* has a plastic washer 474 fitted thereon and defined between the other side of the second tab 43 and the other second fitting sleeve 422, wherein the other side of the second tab 43 is opposite to the adjusting ring 47*c*, and the other second fitting sleeve 422 accommodates the adjusting ring 47*c*, hence friction between the second fitting sleeve 422 and the second tab 43 reduces.

Each of the second tab 43 and the two second fitting sleeves 422 has a polygonal inner wall defined therein; and each of the first toothed seat 47*a* and the two second toothed seats 47*d* has a polygonal outer wall formed thereon.

Accordingly, when the first movable joint 403 or the second movable joint 406 is revolved, it makes sounds so that the user knows accuracy positioning of the support bracket at any angles, and the faucet 1 is secured by the support bracket firmly.

With reference to FIGS. 15-19, a difference of a faucet of a third embodiment from those of the first and second embodiments comprises a support bracket 407 including the first connection portion 40*c*, and the first connection portion 40*c* having a first holding stem 48*a*, wherein the holding stem 48*a* has a head segment 401 rotatably connected with the first tab 41, and the holding stem 48*a* has a contacting segment 481; a second holding stem 48*b* moving along the first holding stem 48*a*, wherein the second holding stem 48*b* has a lock segment 482 and a first coupling segment 404, the lock segment 482 extends out of the head segment 401 of the holding stem 48*a* and locked in the first tab 41, hence the first connection portion 40*c* limitedly rotates relative to and locks with the first tab 41, the first coupling segment 404 is biased against the contacting segment 481 of the holding stem 48*a* and is pulled by an external force to remove the lock segment 482 from the first tab 41; a second coupling segment 405 of the second rotatable connector 40*d* has the second tab 43 rotatably coupled with the first coupling segment 404 of the second holding stem 48*b*.

In other words, the first connection portion 40*c* locks with and unlocks from the first movable joint 403 by pulling and releasing the second holding stem 48*b* so as to adjustably rotate with respective to the first tab of the first rotatable connector 40*a*.

Figure 17:
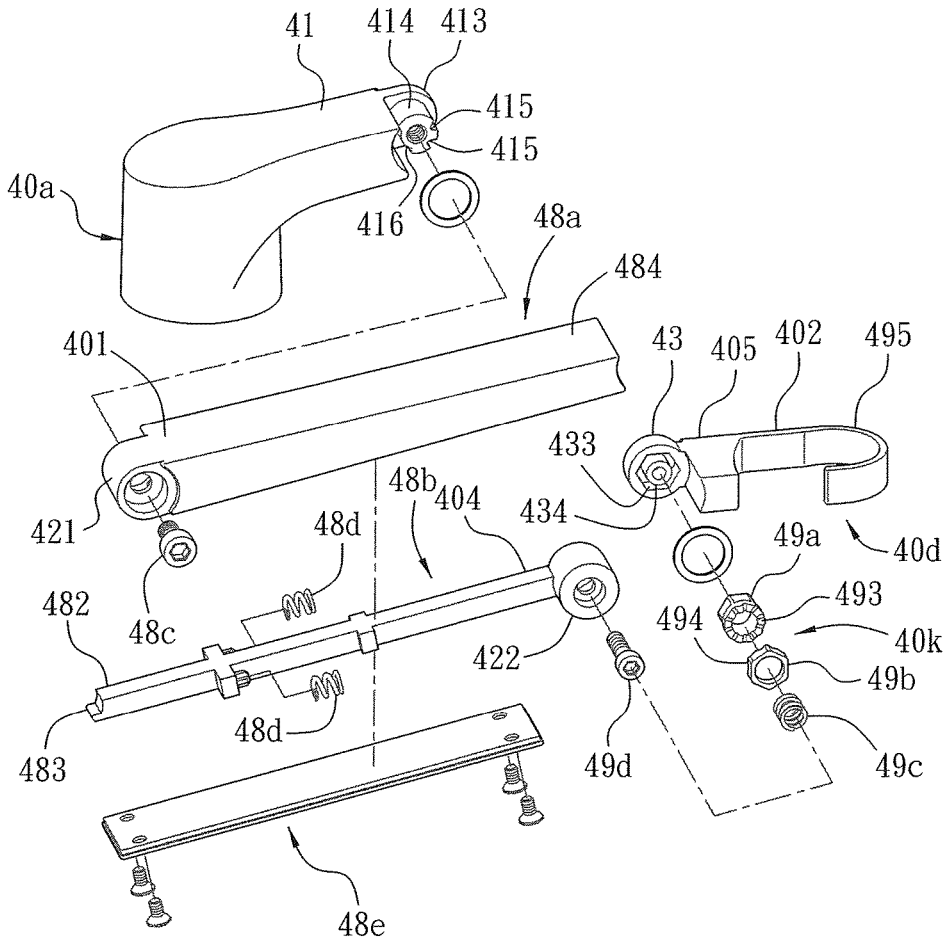
FIG. 17 is a perspective view showing the exploded components of the support bracket of the faucet according to the third embodiment of the present invention.
Figure 18:
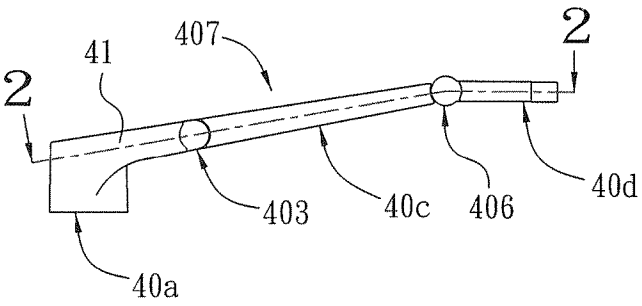
FIG. 18 is a side plan view showing the assembly of the support bracket of the faucet according to the third embodiment of the present invention.
Figure 19:
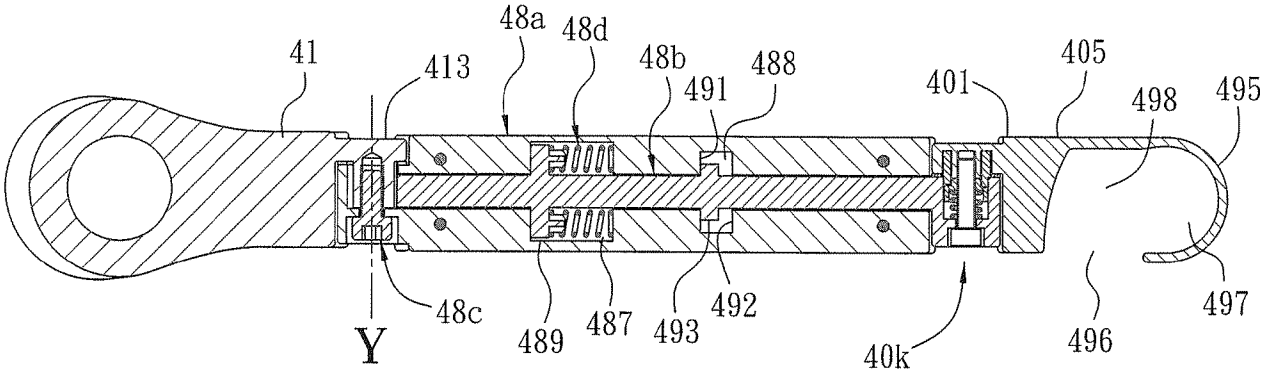
FIG. 19 is a cross sectional view taken the line 2-2 of FIG. 18.
Figure 20:
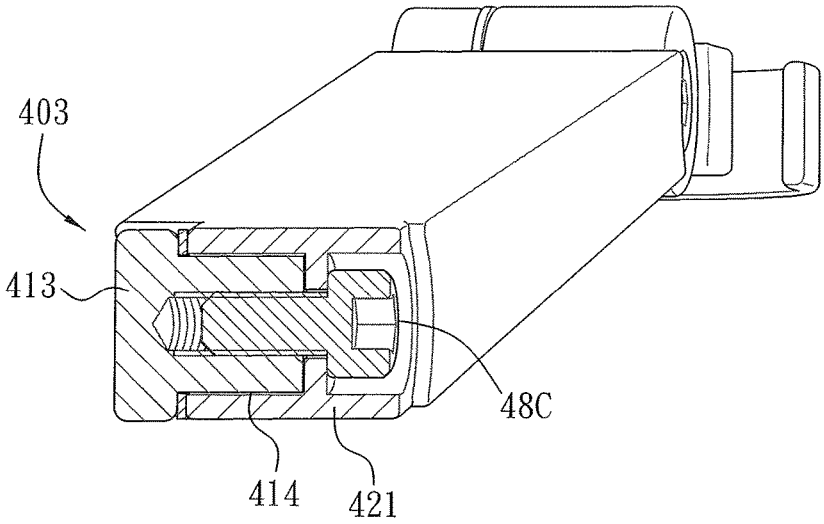
FIG. 20 is a cross-sectional perspective view showing the assembly of a first movable joint of the support bracket of the faucet according to the third embodiment of the present invention.
Figure 22:
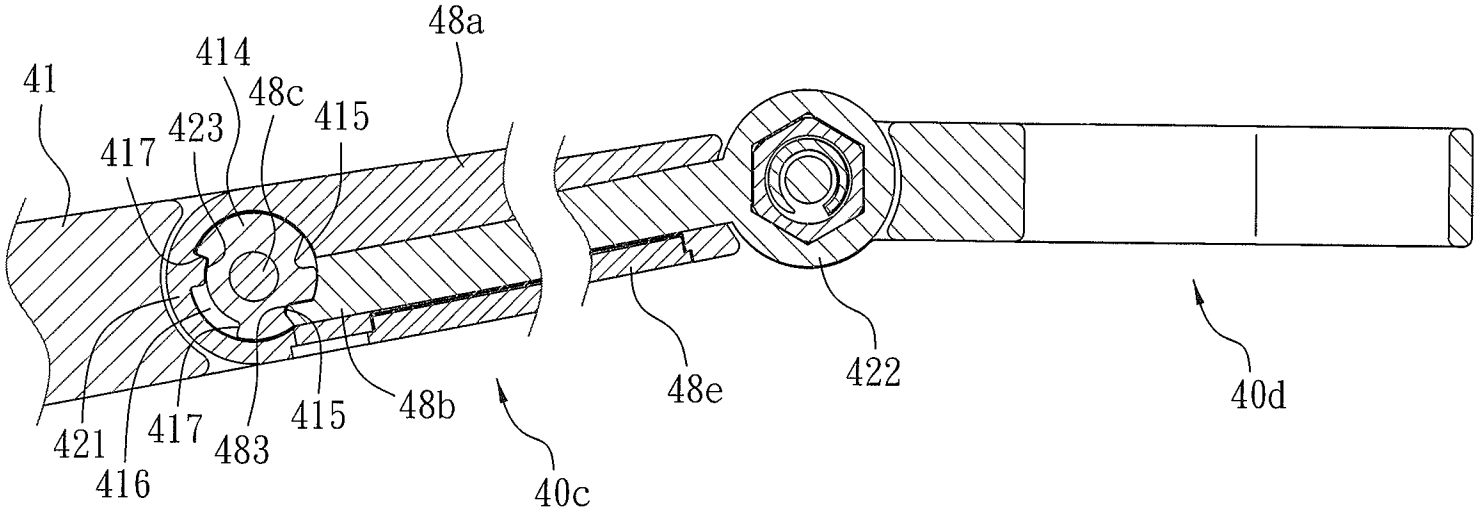
FIG. 22 is a cross sectional view showing the operation of the support bracket of the faucet according to the third embodiment of the present invention.
Figure 23:
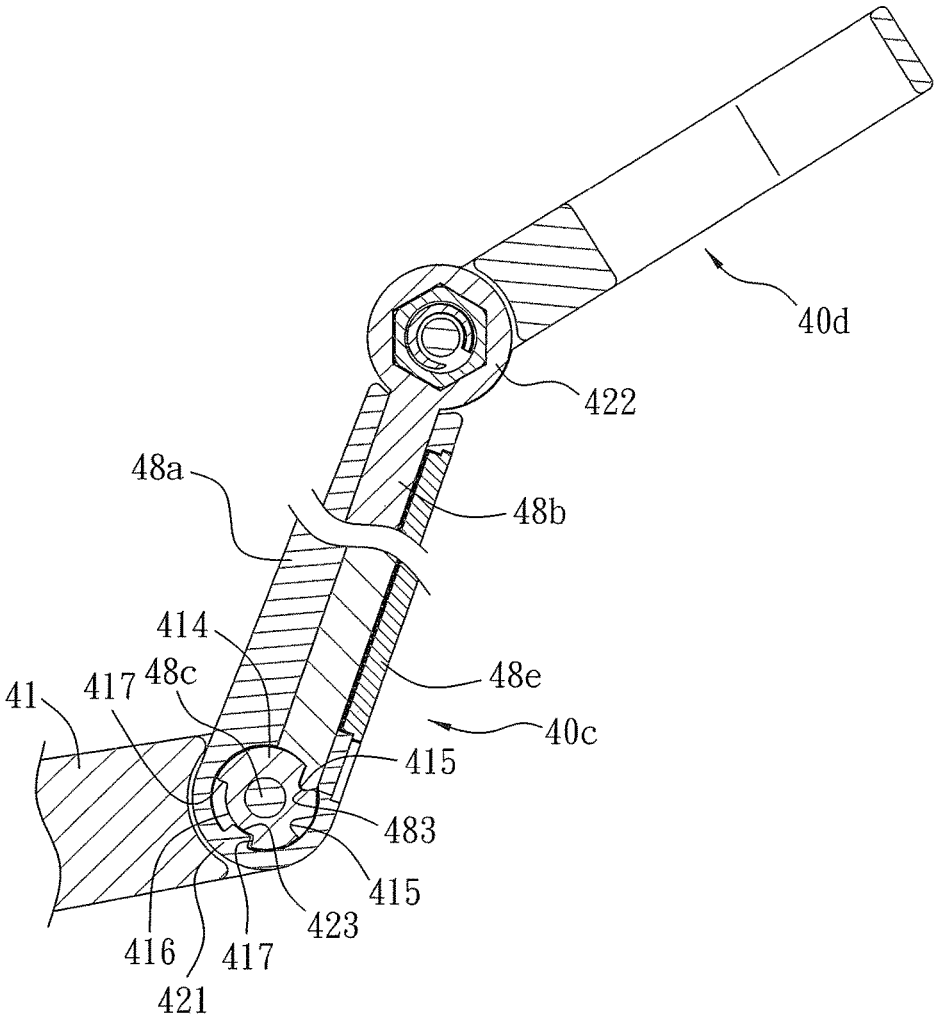
FIG. 23 is another cross sectional view showing the operation of the support bracket of the faucet according to the third embodiment of the present invention.

Referring to FIGS. 17 and 20, the first tab 41 of the first rotatable connector 40*a* has a peripheral fence 413 from which a rotatable post 414 extends outwardly, wherein the first rotation axis Y forms on a central axis of the rotatable post 414, as shown in FIG. 19. The rotatable post 414 has at least two trenches 415 defined on an outer wall thereof, as illustrated in FIGS. 17, 22, 23. The head segment 401 of the first holding stem 48*a* has a first fitting sleeve 421 formed thereon so as to rotatably fit with the rotatable post 414; the first connection portion 40*c* further has a screw bolt 48*c* screwing with the rotatable post 414 so as to limit the first fitting sleeve 421 on the rotatable post 414 and to form the first movable joint 403. The lock segment 482 of the second holding stem 48*b* has a first bulge 483 formed thereon and locked in one of the at least two trenches 415 via the first fitting sleeve 421, hence the first connection portion 40*c* is adjustably fixed on a desired rotation angle.

In this embodiment, two trenches 415 are defined on the outer wall of the rotatable post 414;

The rotatable post 414 has the at least two trenches 415 defined on an outer wall thereof and a trough 416 formed on the outer wall of the rotatable post 414, wherein two limitation fences 417 forms on two sides of the trough 416; the first fitting sleeve 421 has a second bulge 423 extending from an inner wall thereof and limitedly rotating in the trough 416 between the two limitation fences 417; when the second bulge 423 abuts against one of the two limitation fences 417, it locks in the one trench 415; when the second bulge 423 abuts against the other limitation fence 417, it locks in the other trench 415.

Accordingly, the first connection portion 40*c* is rotated toward two angles as shown in FIGS. 22 and 23.

Figure 24:
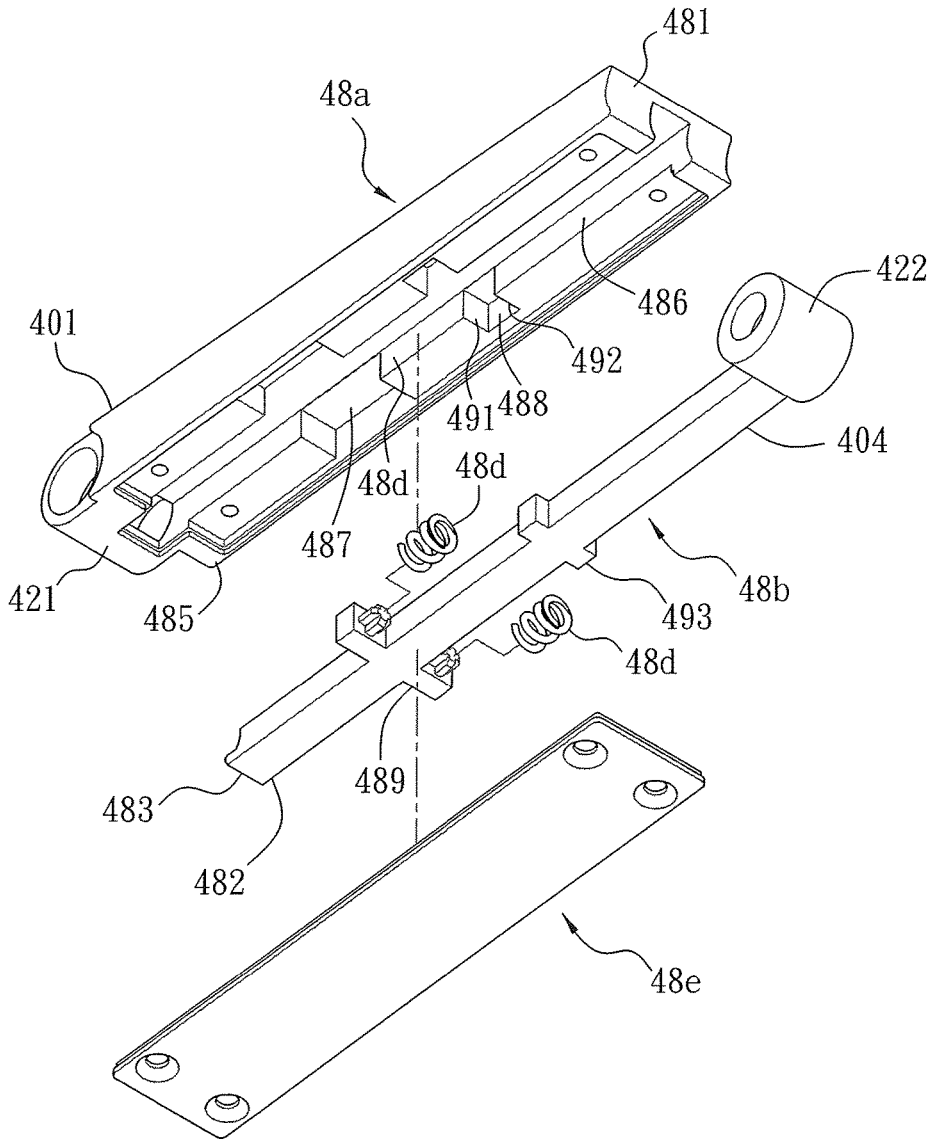
FIG. 24 is a perspective view showing the exploded components of a part of the support bracket of the faucet according to the third embodiment of the present invention.

As shown in FIGS. 17, 19, and 24, the first holding stem 48*a* has an upper face 484 and a lower face 485 opposite to the upper face 484, wherein the lower face 485 has a passing recess 486 extending from the head segment 401 to the contacting segment 481 as shown in FIG. 19, the passing recess 486 has a first recessed part 487 and a second recessed part 488, and the second recessed part 488 has a first stop fence 491 and a second stop fence 492; the second holding stem 48*b* has an affix portion 489 accommodated in the first recessed part 487, and the second holding stem 48*b* has a defining portion 493 limitedly moving between the first stop fence 491 and the second stop fence 492; the first connection portion 40*c* further has two first spring 48*d* accommodated in the first recessed part 487 and abutting against two sides of the affix portion 489 so as to push the lock segment 482 of the second holding stem 48*b* outwardly.

In other words, the defining portion 493 of the second holding stem 48*b* is biased against the stop fence 491 by way of the two first spring 48*d*, and the second bulge 423 locks in the other trench 415. As desiring to adjustably rotate the first connection portion 40*c*, the second holding stem 48*b* is pulled outwardly and resists against the two springs 48*s* so as to remove the second bulge 423 from the other trench 415, hence the first fitting sleeve 421 of the first holding stem 48*a* rotates relative to the first tab 41.

The first connection portion 40*c* further has a covering plate 48*e* configured to close the lower face 485 of the first holding stem 48*a*.

In this embodiment, a second fitting sleeve 422 is formed by the first coupling segment 404 of the second holding stem 48*b*. The second tab 43 is formed by the second coupling segment 405 of the second rotatable connector 40*d*. The second rotatable connector 40*b* has a third rotation set 40*k* configured to rotatably connect the second fitting sleeve 422 with the second tab 43 so as to form the second movable joint 406.

Figure 21:
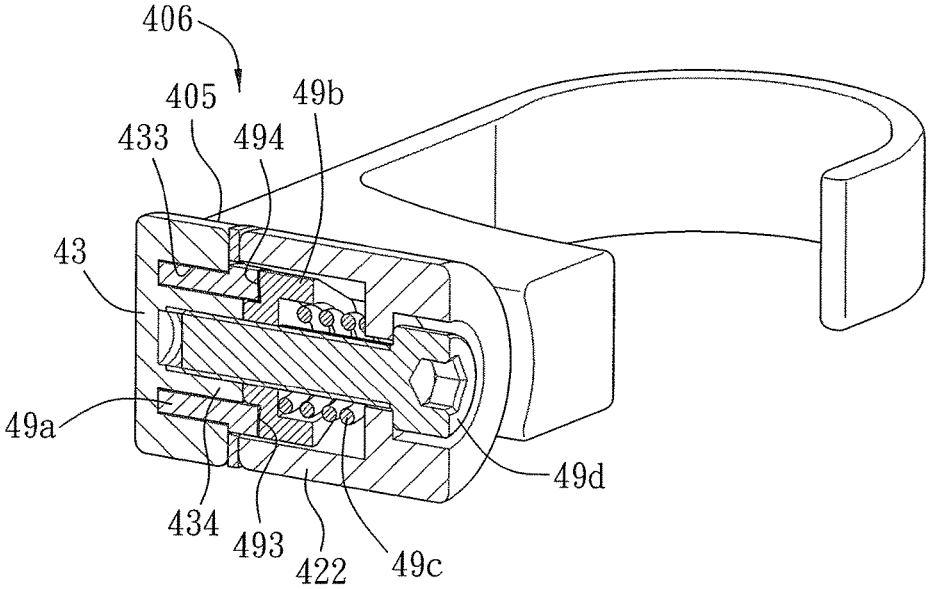
FIG. 21 is a cross-sectional perspective view showing the assembly of a second movable joint of the support bracket of the faucet according to the third embodiment of the present invention.

As illustrated in FIGS. 17, 19, and 21, the second tab 43 has a housing room 433 defined therein and has a pillar 434 extending outwardly from the housing room 433; the second rotation set 40*h* further has a first toothed seat 49*a* rotatably and limitedly housed in the housing room 433, and the first toothed seat 49*a* has a first mesh portion 493; a second toothed seat 49*b* rotatably and limitedly fitted in the second fitting sleeve 422, and the second toothed seat 49*b* has a second mesh portion 494; a second spring 49*c* accommodated in the second fitting sleeve 422 so as to abut against the second toothed seat 49*b*, hence the second mesh portion 494 meshes with the first mesh portion 493; an adjustment bolt 49*d* screwing with the pillar 434 from the second fitting sleeve 422 via the second spring 49*c* and the second toothed seat 49*b* so that the second fitting sleeve 422 is rotatably connected with the second tab 43 to form the second movable joint 406, and the second fitting sleeve 422 is adjustably rotated to change an elasticity of the two first spring 48*d* acting on the second toothed seat 49*b*.

Therefore, the adjustment bolt 49*d* is rotated so as to adjust a resistance against rotation between the second rotatable connector 40*d* and the second holding stem 48*b*.

Each of the housing room 433 and the second fitting sleeve 422 has a polygonal inner wall defined therein; and each of the first toothed seat 49*a* and the second toothed seats 49*b* has a polygonal outer wall formed thereon.

Referring to FIGS. 17 and 19, the distal segment 402 of the support bracket 407 (i.e. the second rotatable connector 40*d*) has a hook 495, an opening 496, a hanging space 497 defined by the hook 495, and a cavity 498 communicating with the opening 496 and the hanging space 497. The spray head 30 includes a neck portion 32 hang on the hook 495 from the opening 496 via the cavity 498 and retained in the hanging space 497, thus handing the spray head 30 on or removing the spray head 30 from the hook 495. The spray head 30 is pulled so as to drive the first bulge 483 to remove from the one the other trench 415 via the second holding stem 48*b*, hence the first connection portion 40*c* is revolved to a desired angle quickly.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A faucet having a support bracket, and the faucet comprising:

a body including a vertical axis extending along a central portion of the body;

a flexible outlet pipe extending outwardly from a top of the body and including an outflow segment;

a spray head being in connection with the outflow segment of the flexible outlet pipe;

a support bracket including a first rotatable connector disposed on the top of the body, and the support bracket including a first tab extending outwardly from the first rotatable connector, wherein the first tab has a first rotation axis separated a distance from and perpendicular to the vertical axis; the support bracket further includes a second rotatable connector having a head segments and a distal segment, wherein the head segment is rotatably connected with the first tab so as to form a first movable joint, and the distal segment is connected with or removed from the spray head; and wherein the second rotatable connector has a first connection portion having the head segment and a first coupling segment; a second connection portion having a second coupling segment and the distal segment, wherein the second coupling segment is rotatably connected with the first coupling segment so as to form a second movable joint;

wherein the first connection portion includes two extensions; the two extensions have the head segment rotatably connected with two sides of the first tab, and the two extensions have the first coupling segment; the second coupling segment of the second connection portion has a second tab, two sides of which are rotatably coupled with the first coupling segment of the two extensions;

wherein the head segment of the two extensions has two first fitting sleeves formed thereon; the first tab has two first columns separately extending outward from the two sides thereof; a first rotation set has two friction loops accommodated in the two first fitting sleeves respectively and limitedly retained on the two sides of the first tab individually, wherein the two friction loops are forced to deform flexibly; two screw bolts are configured to lock the two friction loops with the two first columns separately; two adjustable buttons are respectively screwed into the two first fitting sleeves so as to force the two friction loops to deform flexibly and to contact with the two first fitting sleeves respectively;

wherein the second rotatable connector is configured to rotatably connect the head segment of the two extensions with the two sides of the first tab; a second rotation set is configured to rotatably connect the first coupling segment of the two extension with the two sides of the second tab;

wherein the two friction loops have two insertions separately accommodated in the two sides of the first tab, and the two friction loops respectively have two flexible deformation portions matingly retaining with the two first fitting sleeves; wherein each of the two flexible deformation portions is in a ring shape and has multiple slots defined thereon, each flexible deformation portion has an orifice formed thereon; each of the two adjustable buttons has a contact segment on which a protrusion is formed, and each adjustable button has an abutting face defined around an outer wall of the protrusion so as to abut against each friction loop, and the protrusion is housed in the orifice of each friction loop so that each friction loop flexibly deforms outward.

2. The faucet having the support bracket as claimed in claim 1, wherein each of the two second columns of the second tab has two second fixing notches formed around an outer wall of each second column; and an insertion of each another friction loop has two another projections retained in the two second fixing notches separately.

3. The faucet having the support bracket as claimed in claim 1, wherein the first coupling segment of the two extensions have two second fitting sleeves formed thereon; the second tab has two second columns individually extending outward from the two sides thereof; and the second rotation set has another two friction loops accommodated in the second fitting sleeves respectively and limitedly retained on the two sides of the second tab individually, wherein said another two friction loops are forced to deform flexibly; two another screw bolts are configured to lock said another two friction loops with the two second columns separately of the second tab; two another adjustable buttons are screwed into the two second fitting sleeves respectively so as to force said another two friction loops to deform flexibly and to contact with the second fitting sleeve separately.

4. The faucet having the support bracket as claimed in claim 3, wherein the two friction loops have two insertions separately accommodated in the two sides of the first tab, and the two friction loops respectively have two flexible deformation portions matingly retaining with the two first fitting sleeves respectively; wherein each of the two flexible deformation portions is in a ring shape and has multiple slots defined thereon, each flexible deformation portion has an orifice formed thereon; each of the two adjustable buttons has a contact segment on which a protrusion is formed, and each adjustable button has an abutting face defined around an outer wall of the protrusion so as to abut against each friction loop, and the protrusion is housed in the orifice of each friction loop so that each friction loop flexibly deforms outward.

5. The faucet having the support bracket as claimed in claim 4, wherein each of the two second columns of the second tab has two second fixing notches formed around an outer wall of each second column; and an insertion of each another friction loop has two another projections retained in the two second fixing notches separately.

6. The faucet having the support bracket as claimed in claim 1, wherein between the distal segment of the support bracket and the spray head is defined a magnetic attraction structure so that the spray head is freely removed from the distal segment of the support bracket.

7. The faucet having the support bracket as claimed in claim 6, wherein the distal segment of the support bracket has a peripheral knob made of magnetic attracting material; the spray head includes an accommodation groove defined therein so as to accommodate an annular magnet and to magnetically attracting the peripheral knob in the accommodation groove.

8. A faucet having a support bracket, and the faucet comprising:

a body including a vertical axis extending along a central portion of the body;

a flexible outlet pipe extending outwardly from a top of the body and including an outflow segment;

a spray head being in connection with the outflow segment of the flexible outlet pipe;

a support bracket including a first rotatable connector disposed on the top of the body, and the support bracket including a first tab extending outwardly from the first rotatable connector, wherein the first tab has a first rotation axis separated a distance from and perpendicular to the vertical axis; the support bracket further includes a second rotatable connector having a head segment and a distal segment, wherein the head segment is rotatably connected with the first tab so as to form a first movable joint, and the distal segment is connected with or removed from the spray head; and wherein the second rotatable connector has a first connection portion having the head segment and a first coupling segment; a second connection portion having a second coupling segment and the distal segment, wherein the second coupling segment is rotatably connected with the first coupling segment so as to form a second movable joint;

wherein the first connection portion includes two extensions; the two extensions have the head segment rotatably connected with two sides of the first tab, and the two extensions have the first coupling segment; the second coupling segment of the second connection portion has a second tab, two sides of which are rotatably coupled with the first coupling segment of the two extensions;

wherein the second rotatable connector is configured to rotatably connect the head segment of the two extensions with the two sides of the first tab; a second rotation set is configured to rotatably connect the first coupling segment of the two extension with the two sides of the second tab;

wherein the head segment of the two extensions has two first fitting sleeves formed thereon; the first rotation set includes a first toothed seat rotatably housed in the first tab, and the first toothed seat has two first mesh portions arranged on two ends of the first toothed seat respectively; a positioning ring; an adjusting ring; two second toothed seats rotatably accommodated in the two first fitting sleeves separately, and each of the two second toothed seats has a second mesh portion configured to mesh with each of the two first mesh portions; two springs, one of which is mounted between the positioning ring and one of the two second toothed seats, and the other spring is fixed between the adjusting ring and the other second toothed seat; a rotary shaft screwed with the adjusting ring from the positioning ring via the one spring, the one second toothed seat, and the first toothed seat, such that the positioning ring, the one second toothed seat, and the adjusting ring are rotatably connected with the first toothed seat, wherein the two springs push against the two second toothed seats separately so that two second mesh portions of the two second toothed seats mesh with the two first mesh portions individually; two caps are screwed with the positioning ring and the adjusting ring so as to rotatably connect the two first fitting sleeves with the first tab.

9. The faucet having the support bracket as claimed in claim 8, wherein the first toothed seat has a limiting rib extending outwardly from an outer end thereof so as to abut the first toothed seat against one side of the first tab opposite to the one positioning ring; the first toothed seat has a plastic washer fitted thereon and defined between the other side of the first tab and one of the two first fitting sleeves, wherein the other side of the first tab is opposite to the adjusting ring, and the one first fitting sleeve accommodates the adjusting ring.

10. The faucet having the support bracket as claimed in claim 8, wherein each of the two first mesh portions and the two second mesh portions has multiple teeth arranged thereon.

11. The faucet having the support bracket as claimed in claim 8, wherein each of the first tab and the two first fitting sleeves has a polygonal inner wall defined therein; and each of the first toothed seat and the two second toothed seats has a polygonal outer wall formed thereon.

12. The faucet having the support bracket as claimed in claim 8, wherein the first coupling segment of the two extensions has two second fitting sleeves formed thereon; the second rotation set includes a first toothed seat rotatably housed in the first tab, and the first toothed seat has two first mesh portions arranged on two ends of the first toothed seat respectively; a positioning ring; an adjusting ring; two second toothed seats are rotatably accommodated in the two first fitting sleeves separately, and each of the two second toothed seats has a second mesh portion configured to mesh with each of the two first mesh portions; two springs, one of which is mounted between the positioning ring and one of the two second toothed seats, and the other spring is fixed between the adjusting ring and the other second toothed seat; a rotary shaft is screwed with the adjusting ring from the positioning ring via the one spring, the one second toothed seat, and the first toothed seat, such that the positioning ring, the one second toothed seat, and the adjusting ring are rotatably connected with the first toothed seat, wherein the two springs push against the two second toothed seats separately so that two second mesh portions of the two second toothed seats mesh with the two first mesh portions individually; two caps are screwed with the positioning ring and the adjusting ring so as to rotatably connect the two first fitting sleeves with the first tab.

13. The faucet having the support bracket as claimed in claim 12, wherein the first toothed seat has a limiting rib extending outwardly from an outer end thereof so as to abut the first toothed seat against one side of the first tab opposite to the one positioning ring; the first toothed seat has a plastic washer fitted thereon and defined between the other side of the first tab and one of the two first fitting sleeves, wherein the other side of the first tab is opposite to the adjusting ring, and the one first fitting sleeve accommodates the adjusting ring.

14. The faucet having the support bracket as claimed in claim 12, wherein each of the two first mesh portions and the two second mesh portions has multiple teeth arranged thereon.

15. The faucet having the support bracket as claimed in claim 12, wherein each of the first tab and the two first fitting sleeves has a polygonal inner wall defined therein; and each of the first toothed seat and the two second toothed seats has a polygonal outer wall formed thereon.

16. A faucet having a support bracket, and the faucet comprising:

a body including a vertical axis extending along a central portion of the body;

a flexible outlet pipe extending outwardly from a top of the body and including an outflow segment;

a spray head being in connection with the outflow segment of the flexible outlet pipe;

a support bracket including a first rotatable connector disposed on the top of the body, and the support bracket including a first tab extending outwardly from the first rotatable connector, wherein the first tab has a first rotation axis separated a distance from and perpendicular to the vertical axis; the support bracket further includes a second rotatable connector having a head segment and a distal segment, wherein the head segment is rotatably connected with the first tab so as to form a first movable joint, and the distal segment is connected with or removed from the spray head;

wherein the second rotatable connector has a first connection portion having the head segment and a first coupling segment; a second connection portion having a second coupling segment and the distal segment, wherein the second coupling segment is rotatably connected with the first coupling segment so as to form a second movable joint;

wherein the first connection portion has a first holding stem, wherein the holding stem has the head segment rotatably connected with the first tab, and the holding stem has a contacting segment; a second holding stem moving along the first holding stem, wherein the second holding stem has a lock segment and the first coupling segment, the lock segment extends out of the head segment of the holding stem and locked in the first tab, hence the first connection portion limitedly rotates relative to and locks with the first tab, the first coupling segment is biased against the contacting segment of the holding stem and is pulled by an external force to remove the lock segment from the first tab; the second coupling segment of the second rotatable connector has a second tab rotatably coupled with the first coupling segment of the second holding stem;

wherein the first tab of the first rotatable connector has a peripheral fence from which a rotatable post extends outwardly, wherein the first rotation axis forms on a central axis of the rotatable post, the rotatable post has at least two trenches defined on an outer wall thereof; the head segment of the first holding stem has a first fitting sleeve formed thereon so as to rotatably fit with the rotatable post; the first connection portion further has a screw bolt screwing with the rotatable post so as to limit the first fitting sleeve on the rotatable post; the lock segment of the second holding stem has a first bulge formed thereon and locked in one of the at least two trenches via the first fitting sleeve, hence the first connection portion is adjustably fixed on a desired rotation angle.

17. The faucet having the support bracket as claimed in claim 16, wherein the rotatable post has two trenches defined on an outer wall thereof and has a trough formed on the outer wall of the rotatable post; wherein two limitation fences forms on two sides of the trough; the first fitting sleeve has a second bulge extending from an inner wall thereof and limitedly rotating in the trough between the two limitation fences; when the second bulge abuts against one of the two limitation fences, it locks in the one trench; when the second bulge abuts against the other limitation fence, it locks in the other trench.

18. The faucet having the support bracket as claimed in claim 16, wherein the first holding stem has an upper face and a lower face opposite to the upper face, wherein the lower face has a passing recess extending from the head segment to the contacting segment, the passing recess has a first recessed part and a second recessed part, and the second recessed part has a first stop fence and a second stop fence; the second holding stem has an affix portion accommodated in the first recessed part, and the second holding stem has a defining portion limitedly moving between the first stop fence and the second stop fence; the first connection portion further has at least one first spring accommodated in the first recessed part and abutting against two sides of the affix portion so as to push the lock segment of the second holding stem outwardly.

19. The faucet having the support bracket as claimed in claim 18, wherein the first connection portion further has a covering plate configured to close the lower face of the first holding stem.

20. The faucet having the support bracket as claimed in claim 16, wherein the first coupling segment has a second fitting sleeve formed thereon; the second coupling segment of the second connection portion has a second tab; the second rotatable connector has a third rotation set configured to rotatably connect the second fitting sleeve with the second tab.

21. The faucet having the support bracket as claimed in claim 20, wherein the second tab has a housing room defined therein and has a pillar extending outwardly from the housing room; the second rotation set further has a first toothed seat rotatably and limitedly housed in the housing room, and the first toothed seat has a first mesh portion; a second toothed seat rotatably and limitedly fitted in the second fitting sleeve, and the second toothed seat has a second mesh portion; a second spring accommodated in the second fitting sleeve so as to abut against the second toothed seat, hence the second mesh portion meshes with the first mesh portion; an adjustment bolt screwing with the pillar from the second fitting sleeve via the second spring and the second toothed seat so that the second fitting sleeve is rotatably connected with the second tab to form the second movable joint, and the second fitting sleeve is adjustably rotated to change an elasticity of the two first spring acting on the second toothed seat.

22. The faucet having the support bracket as claimed in claim 21, wherein each of the housing room and the second fitting sleeve has a polygonal inner wall defined therein; and each of the first toothed seat and the second toothed seats has a polygonal outer wall formed thereon.

23. The faucet having the support bracket as claimed in claim 16, wherein the distal segment of the support bracket has a hook, an opening, a hanging space defined by the hook, and a cavity communicating with the opening and the hanging space; the spray head includes a neck portion hang on the hook from the opening via the cavity and retained in the hanging space.

* * * * *